US005884506A

United States Patent [19]

Blauert et al.

[11] Patent Number: 5,884,506

[45] Date of Patent: Mar. 23, 1999

[54] WASHING MACHINE WITH A DETERGENT DISPENSER

[75] Inventors: Peter Blauert; Horst Schermuck; Wolfgang Proppe; Andreas Stolze, all of Berlin, Germany

[73] Assignee: BSH Bosch und Siemens Hausgeraete GmbH, Munich, Germany

[21] Appl. No.: 581,393

[22] Filed: Dec. 29, 1995

[30] Foreign Application Priority Data

Dec. 29, 1994 [DE] Germany ..... 44 47 160.2

[51] Int. Cl.[6] ..... B08G 3/02; D06F 39/02

[52] U.S. Cl. ..... 68/17 R; 68/207; 68/12.18; 222/651

[58] Field of Search ..... 68/17 R, 207, 68/12.18; 222/651

[56] References Cited

U.S. PATENT DOCUMENTS

| | | | |
|---|---|---|---|
| 3,942,341 | 3/1976 | Sang | 68/207 |
| 3,949,576 | 4/1976 | Waugh et al. | 68/207 |
| 4,043,158 | 8/1977 | Bochan | 68/207 |
| 4,111,011 | 9/1978 | Waugh | 68/207 |
| 5,375,438 | 12/1994 | Babuin | 68/17 R |

FOREIGN PATENT DOCUMENTS

| | | |
|---|---|---|
| 1460888 | 5/1969 | Germany . |
| 2232020 | 1/1974 | Germany . |
| 2305678 | 8/1974 | Germany . |
| 3021999 | 3/1981 | Germany . |
| 1-242094 | 9/1989 | Japan . |
| 2104109 | 3/1983 | United Kingdom . |

*Primary Examiner*—Frankie L. Stinson
*Attorney, Agent, or Firm*—Herbert L. Lerner; Laurence A. Greenberg

[57] ABSTRACT

A washing machine includes a detergent dispenser having at least one fresh-water connection, a free air course disposed downstream of the at least one fresh-water connection, and a detergent chamber. A water guide conduit supplies fresh water to the detergent chamber. A fresh-water diversion line is connected to the water guide conduit downstream of the free air course.

5 Claims, 2 Drawing Sheets

WASHING MACHINE WITH A DETERGENT DISPENSER

BACKGROUND OF THE INVENTION

FIELD OF THE INVENTION

The invention relates to a washing machine with a detergent or washing agent dispenser having at least one fresh-water connection, a free air course downstream thereof and a water guide conduit for supplying the fresh water to a detergent chamber, and a fresh-water diversion line.

Such a washing machine is known from German Published, Non-Prosecuted Patent Application DE 38 22 392 A1. There, diverted fresh water is used to fill a pumping-out line, so that a ball valve mounted on the bottom of the tub will be acted upon with sufficient static pressure for reliable closure before detergent is fed into the tub from above through the water guide conduit and the detergent chamber. In one of the exemplary embodiments, the fresh-water diversion line is extended by way of its own free air course. The constrained space in a detergent dispenser and demands in terms of manufacture made of such a dispenser mean that the known proposal does not appear practicable.

SUMMARY OF THE INVENTION

It is accordingly an object of the invention to provide a washing machine with a detergent dispenser, which overcomes the hereinafore-mentioned disadvantages of the heretofore-known devices of this general type and which integrates a fresh-water diversion line into a detergent dispenser in such a way that on one hand sufficient pressure for the intended tasks is available both in the diversion line and in a water guide conduit, but on the other hand the detergent dispenser is not expanded to take up any more space. In realizing the invention, demands for easy manufacture of the detergent dispenser from thermoplastic synthetic must also be met.

With the foregoing and other objects in view there is provided, in accordance with the invention, a washing machine, comprising a detergent dispenser having at least one fresh-water connection, a free air course disposed downstream of the at least one fresh-water connection, and a detergent chamber; a water guide conduit for supplying fresh water to the detergent chamber; and a fresh-water diversion line being connected to the water guide conduit downstream of the free air course.

As a result, a space inside the top part of a housing can be used for the dispenser, which space is otherwise occupied only by a nearly straight-line conduit segment that is from 40 to 60 mm long. Since the diversion line is integrated into the upper part of a detergent dispenser in the same way as the water guide conduits, nothing in the mode of manufacture of this upper part of the detergent dispenser changes.

As compared with the previous situation, expensive production processes can thus be avoided. Since there is no change in the total conduit cross section downstream of the free air course, the previously prevailing pressure of the water guide conduit is preserved in both of the lines that extend downstream of the diversion.

In accordance with another feature of the invention, the diversion line is connected to the water guide conduit for a prewash product chamber. Since the prewash product chamber is used seldom, or when used is rinsed out as the first chamber, it is available for further use as a water supply course both directly through the prewash chamber and through the diversion line thereof.

In accordance with a further feature of the invention, in a washing machine having a loading door on the front with a transparent bull's-eye window, the diversion line communicates hydraulically with a nozzle that is aimed from above at the inside of the bull's-eye window. The diverted fresh water is utilized for additional wetting of the laundry. This wetting typically occurs as the laundry sweeps past the bull's-eye window. Moreover, despite the trend to an extreme reduction in washing fluid, the operator can see from this that the washing machine is taking in water and feeding it into the tub.

In accordance with an added feature of the invention, in a washing machine being equipped with an elastic cuff between an outer housing and a tub, the nozzle is formed-in as a component of the cuff. The diverted fresh water can most easily be carried from the cuff to the inner surface of the bull's-eye window. From a production standpoint, forming the nozzle into the cuff presents no problems. It replaces separate components for the nozzle that would otherwise be needed.

In accordance with a concomitant feature of the invention, in a washing machine which is equipped with a device for drying the washed laundry and for condensing moisture expelled from the laundry in a water-cooled condenser, the diversion line communicates hydraulically with a coolant water nozzle of the condenser. The diverted fresh water can be utilized for rinsing the inner wall surface of the condenser, to free it of any fluff that has settled there.

Other features which are considered as characteristic for the invention are set forth in the appended claims.

Although the invention is illustrated and described herein as embodied in a washing machine with a detergent dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
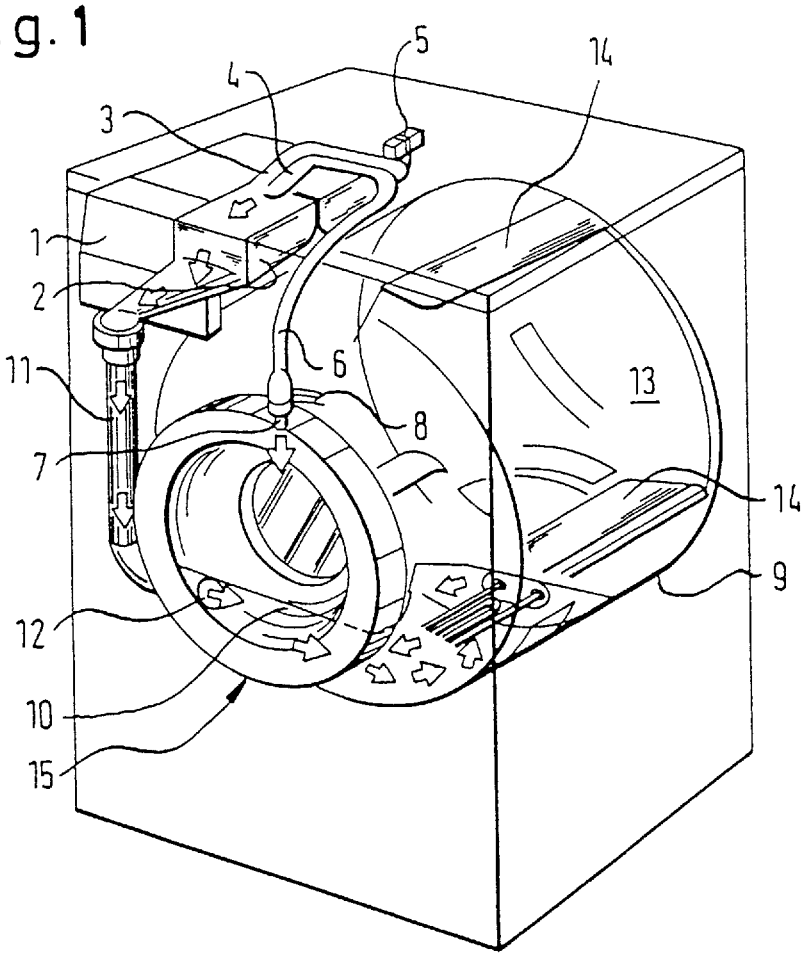
FIG. 1 is a diagrammatic, perspective view of a washing machine, which is shown as being transparent, with details required for an explanation of the invention.

Referring now to the figures of the drawing in detail and first, particularly, to FIG. 1 thereof, there is seen a washing machine which has a detergent or washing agent dispenser 1 that is shown as being partly broken away. The broken-away part diagrammatically shows a detergent dispenser chamber 2 with conduit segments 3 and 4 of an upper housing part for the detergent dispenser. The conduit segment 3 is a water guide conduit which is connected to a solenoid valve 5 for supplying fresh water into the detergent dispenser chamber 2. As described below, some of the fresh water supplied through the water guide conduit 3 can be diverted with the conduit segment 4, which is a fresh-water diversion line, and supplied through a hose 6 to a nozzle 7 in a cuff 8 between an outer housing of the washing machine and a tub 9. In the process, an inner surface of a bull's-eye window 10 is rinsed. In the tub 9, this rinsing water recombines with the fresh water which is primarily supplied through the detergent chamber 2 and fed through a feed tube 11 and an opening 12 to the tub 9.

In the example of FIG. 1, the diverted fresh water serves the purpose of additionally wetting the laundry which is thrown about in the drum 13, from a different side than occurs, for instance, by sprinkling through the use of scoop devices disposed in vanes 14. Since the drum 13 is open at the front anyway because a front loading door 15 is used, this opening is available for supplying the diverted fresh water. However, if for structural reasons other openings of the drum 13 are suitable for this purpose, then the diverted fresh water can be supplied through the use of additional or different nozzles.

Figure 2:
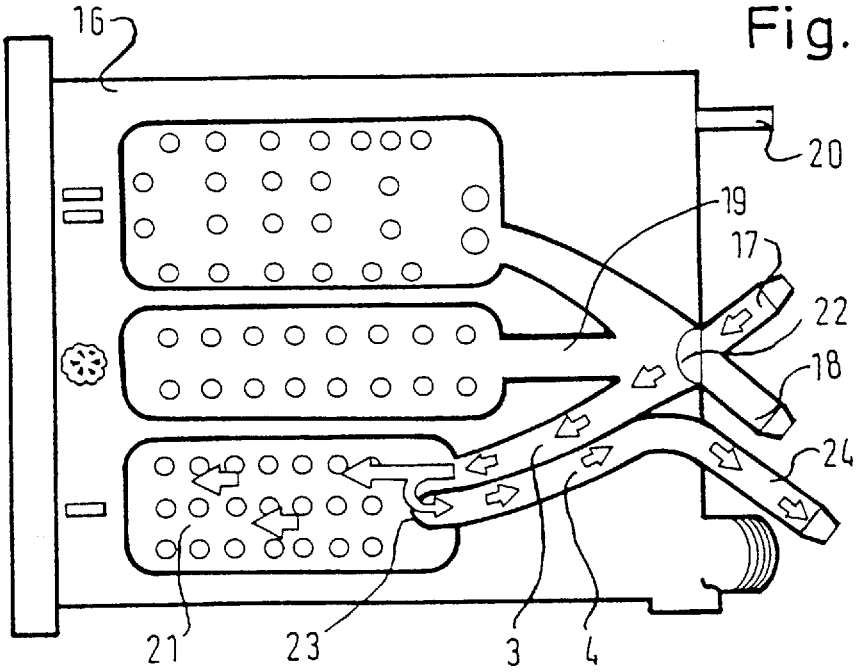
FIG. 2 is a plan view of an upper part for a detergent dispenser according to the invention.
Figure 3:
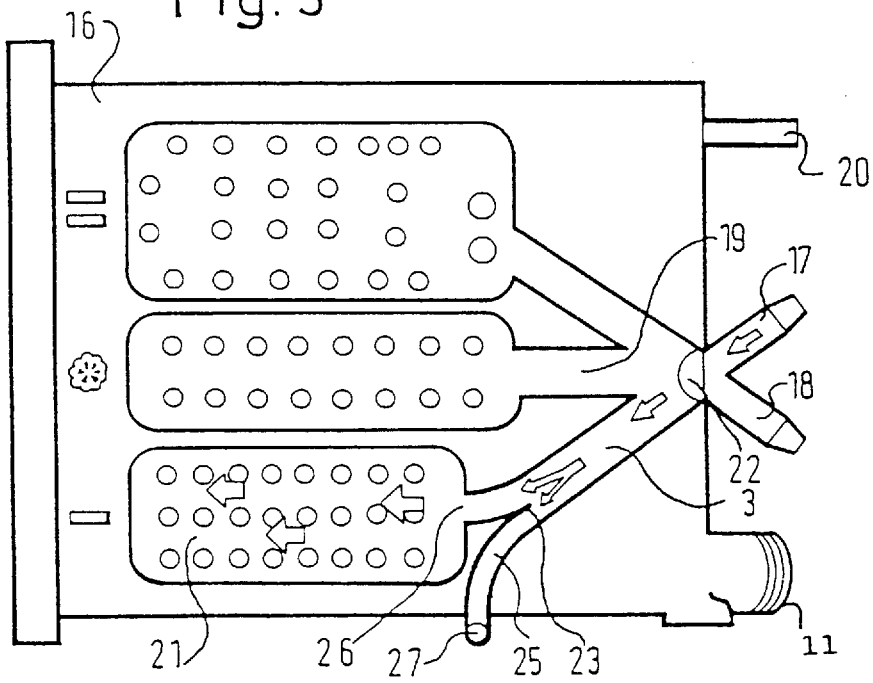
FIGS. 3 and 4 are further variants of FIG. 2.
Figure 4:
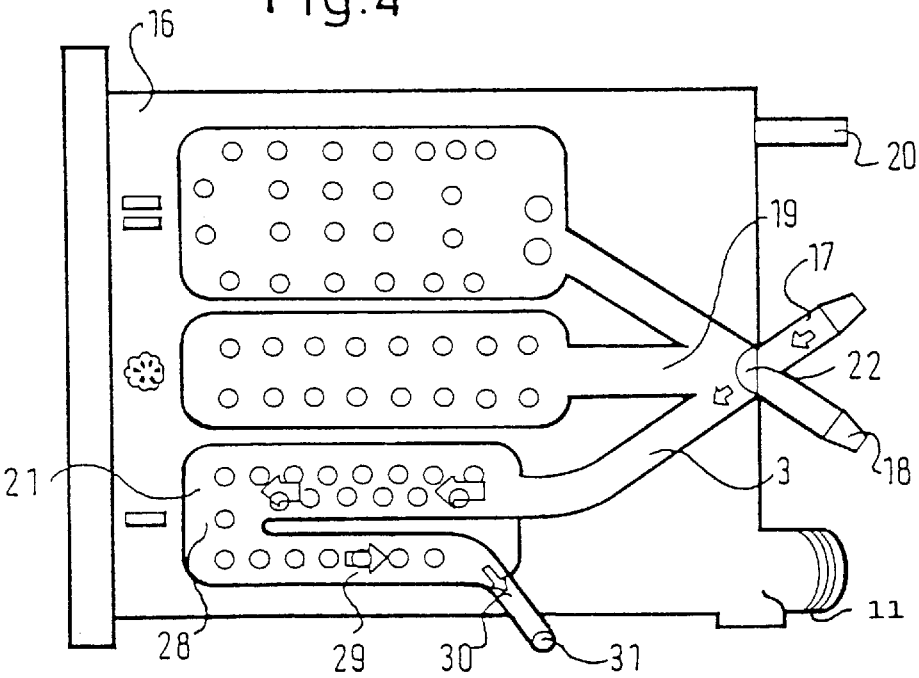

The illustrations in FIGS. 2–4 show the outlines of a detergent dispenser shell 16, that is of a housing provided for such a shell. For the sake of illustrating the structure of the upper part of such a housing through the use of water guide conduits, it has been illustrated with its top plate removed. The water guide conduits are shown for respective detergent chambers located beneath them for a prewash product (represented by the symbol of a horizontal bar), a main detergent (represented by the symbol of two horizontal bars), and a fabric softener (represented by the symbol of a flower). In order to supply the detergent chambers with fresh water, an intersecting system of water guide conduits with fresh-water necks 17 and 18 is used. These necks, which are individually triggered, supply fresh water to the chambers for the prewash product (one bar) and the main detergent (two bars). If the two necks 17 and 18 are triggered simultaneously, the result at the point of intersection is a jet of water that strikes the inside of a water guide conduit 19 and assures a supply of fresh water to the chamber for fabric softener. In an upper region of the housing 16, a ventilation neck 20 is also provided, but it is of no significance to the invention. Below the intersection of the fresh-water jets, a spacious collecting chamber for water with detergent and leaking water is provided, which opens into the tub 9 through the feed tube 11. The intersection point of the water guide conduits communicates with the collecting chamber through a free air course 22. The water guide conduits finally discharge into distribution chambers 21 located above the detergent chambers, and from there the fresh water is sprayed into the detergent chambers through holes in the bottoms of the distribution chambers.

In the upper part of the housing shown in FIG. 2, the water guide conduit 3 communicates with the diversion or branch line 4 at a point of entry into the distribution chamber 21. To that end, a partition 23 that divides the fresh-water stream from the water guide conduit 3 is provided in the entry region. The partition 23 supplies the diverted water through the diversion line 4 to a neck 24. This neck 24 can be connected through the hose 6 to the nozzle 7 shown in FIG. 1.

In FIG. 3, the diversion point is constructed differently. In this case, emphasis is placed on having the most laminar possible flow of fresh water, diverted below the dividing partition 23, through a slightly curved diversion line 25. Major changes of direction have been avoided in this case. In addition, the predominant proportion of the supplied fresh water is guided by an entry point 26 that is adapted fluidically to the distribution chamber 21, so that no undesired vortices can be created as a result of diversion devices. The diverted fresh water is supplied through the diversion line 25 to a downward-pointing neck 27, to which the hose 6 leading to the nozzle 7 can be connected in turn.

In the exemplary embodiment shown in FIG. 4, the major emphasis has been placed on the action of the fresh water which is supplied through the water guide conduit 3, on the uniform, full-pressure distribution and rinsing of the prewash product chamber located beneath. To that end, in a known manner the water distribution chamber 21 is divided into two parallel conduit segments, through which the flow takes place in opposite directions, and which communicate with one another through a deflection region 28. A conduit segment 29, which is the last conduit segment as seen in the flow direction, communicates at its end with a diversion line 30, which supplies the fresh water that is still remaining in accordance with the pressure distribution, to a neck 31, that can in turn communicate through the hose 6 with the nozzle 7.

The exemplary embodiments described above can merely explain the principle of the invention. However, the present inventive principle can be applied as well to other forms of detergent dispensers, in which fresh water is supplied to the detergent chambers in some other way.

We claim:

1. A washing machine, comprising:

a detergent dispenser having at least two fresh-water connections, an intersection chamber for providing a free air course disposed downstream of said at least two fresh-water connections, and a detergent chamber;

a water guide conduit connected to said intersection chamber for supplying fresh water to said detergent chamber; and a fresh-water diversion line connected to said water guide conduit downstream of said intersection chamber, said fresh-water diversion line and said detergent dispenser being formed in one piece.

2. The washing machine according to claim 1, wherein said detergent chamber includes a prewash product chamber, and said diversion line is connected to said water guide conduit for said prewash product chamber.

3. The washing machine according to claim 1, including a front loading door having a transparent bull's-eye window with an inner surface, and a nozzle being aimed from above at said inner surface of said bull's-eye window, said diversion line communicating hydraulically with said nozzle.

4. The washing machine according to claim 3, including an outer housing, a tub, and an elastic cuff disposed between said outer housing and said tub, said nozzle being an integrally formed-in component of said cuff.

5. In a washing machine having a device for drying washed laundry and for condensing moisture expelled from the laundry in a water-cooled condenser having a coolant water nozzle, the improvement comprising:

a detergent dispenser having at least two fresh-water connections, an intersection chamber for providing a free air course disposed downstream of said at least two fresh-water connections, and a detergent chamber;

a water guide conduit connected to said intersection chamber for supplying fresh water to said detergent chamber; and a fresh-water diversion line connected to said water guide conduit downstream of said intersection chamber and hydraulically communicating with the coolant water nozzle of the condenser, said fresh-water diversion line and said detergent dispenser being formed in one piece.

* * * * *